US008550871B1

(12) United States Patent
Baratta

(10) Patent No.: US 8,550,871 B1
(45) Date of Patent: Oct. 8, 2013

(54) CUTTING MATERIAL INTO A DESIRED FINAL BRASSIERE SHAPE

(76) Inventor: Michele Patrice Baratta, Alpharetta, GA (US)

( * ) Notice: Subject to any disclaimer, the term of this patent is extended or adjusted under 35 U.S.C. 154(b) by 630 days.

(21) Appl. No.: 12/750,776

(22) Filed: Mar. 31, 2010

(51) Int. Cl.
*A41C 3/00* (2006.01)

(52) U.S. Cl.
USPC ..... 450/39; 450/1; 450/81

(58) Field of Classification Search
USPC ..... 450/81, 39, 37, 38, 41, 54–57, 1
See application file for complete search history.

(56) References Cited

U.S. PATENT DOCUMENTS

| | | | | |
|---|---|---|---|---|
| 2,400,499 | A | 5/1946 | Gerace | |
| 2,782,418 | A | 2/1957 | Garson | |
| 3,772,899 | A * | 11/1973 | Novi | 66/176 |
| 5,221,227 | A | 6/1993 | Michels | |
| 5,439,409 | A * | 8/1995 | McCracken et al. | 450/31 |
| 5,980,359 | A | 11/1999 | Brown | |
| 6,336,839 | B1 | 1/2002 | Valli | |
| 6,390,885 | B1 | 5/2002 | Brooks | |
| 6,804,833 | B2 * | 10/2004 | Bertola | 2/243.1 |
| 6,863,589 | B2 * | 3/2005 | Cano | 450/65 |
| 7,128,635 | B1 * | 10/2006 | Liu | 450/39 |
| 7,335,086 | B1 * | 2/2008 | Karon | 450/81 |
| 7,435,155 | B2 | 10/2008 | Reinisch et al. | |
| 7,662,019 | B2 * | 2/2010 | Faircloth et al. | 450/92 |
| 2002/0022433 | A1 | 2/2002 | Yeung et al. | |
| 2004/0117895 | A1 | 6/2004 | Fortner | |
| 2007/0010165 | A1 | 1/2007 | Yudkoff | |
| 2009/0075562 | A1 | 3/2009 | Lung | |
| 2009/0093189 | A1 | 4/2009 | Frey | |
| 2009/0138064 | A1 | 5/2009 | Horn | |
| 2009/0258572 | A1 | 10/2009 | Chayo | |

FOREIGN PATENT DOCUMENTS

| | | |
|---|---|---|
| GB | 2394884 | 5/2004 |
| WO | WO 2006/107286 | 10/2006 |

* cited by examiner

*Primary Examiner* — Gloria Hale
(74) *Attorney, Agent, or Firm* — Hartman & Citrin LLC

(57) ABSTRACT

A customizable brassiere is disclosed. The customizable brassiere can be formed from one or more layers of materials. The customizable brassiere, or a portion thereof, can have one or more cups for receiving the breasts and for supporting the breasts in a desired position. Attachment tabs can be attached to or formed into a portion of the customizable brassiere. The attachment tabs can be used to attach the customizable brassiere to the body of the wearer and/or to an article of clothing, if desired. The customizable brassiere can be cut to the desired configuration based upon an outfit the wearer plans to wear, or according to other needs or preferences. The customizable brassiere can include a number of fastening mechanisms, which may be accessed via access areas formed in one or more layers of the customizable brassiere. A strap can be configured to attach to the fastening mechanisms.

19 Claims, 4 Drawing Sheets

CUTTING MATERIAL INTO A DESIRED FINAL BRASSIERE SHAPE

BACKGROUND

The present disclosure relates generally to brassieres. More specifically, the present disclosure relates to customizable brassieres.

A brassiere, often referred to colloquially as a bra, is an undergarment that is primarily used to provide support for the breasts of the wearer. In addition to providing support for the breasts, brassieres may be worn to prevent movement of the breasts during exercise or other physical activity, to provide additional concealment for the breasts and/or details of the breast anatomy, to improve the perceived shape of the breasts, to enlarge or reduce the perceived size of the breasts, and/or for other reasons.

Brassieres come in a variety of styles, sizes, and colors. For example, some brassieres are designed for particular activities and/or attire, e.g., nursing brassieres, sports brassieres, pushup brassieres, and the like. Similarly, various colors and sizes of brassieres are available to accommodate various skin colors, various clothing colors, varying degrees of clothing transparency and/or opacity, and women of varying height, weight, and dimensions. A woman may own a variety of brassieres, each of which is designed to accommodate one or more outfits, one or more activities, and/or other purposes.

It is with respect to these and other considerations that the disclosure made herein is presented.

SUMMARY

The present disclosure is directed to customizable brassieres, and methods of forming and using customizable brassieres. A customizable brassiere can be formed from one or more layers of materials. According to some embodiments, the customizable brassiere includes a front portion. According to other embodiments, the customizable brassiere is substantially tubular. According to yet other embodiments, the customizable brassiere includes a back closure or a side closure to accommodate a "razor-back" configuration. The customizable brassiere, or a portion thereof, can have one or more cups for receiving the breasts and for supporting the breasts in a desired position. The cups can be soft, semi-rigid, and/or rigid, and can include elastic bands, underwires, and/or other support mechanisms.

Attachment tabs can be attached to or formed into a portion of the customizable brassiere. The attachment tabs can be used to attach the customizable brassiere to the body of the wearer and/or to an article of clothing, if desired. The wearer can determine the proper configuration of the customizable brassiere based upon an outfit the wearer plans to wear, or according to other needs or preferences. The customizable brassiere can be cut to the desired configuration.

The customizable brassiere further can include a number of fastening mechanisms, which may be accessed via access areas formed in one or more layers of the customizable brassiere. A strap can be configured to attach to the fastening mechanisms, which may be accessed via the access areas formed in the customizable brassiere. The fastening mechanisms, and thus the access areas, can be configured and placed in the customizable brassiere to accommodate a wide range of styles and configurations, thereby allowing a user to use the customizable brassiere with a wide range of clothing, and to configure the strap in a desired orientation. These and various other features will be apparent from a reading of the following Detailed Description and a review of the associated drawings.

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DETAILED DESCRIPTION

Figure 1:
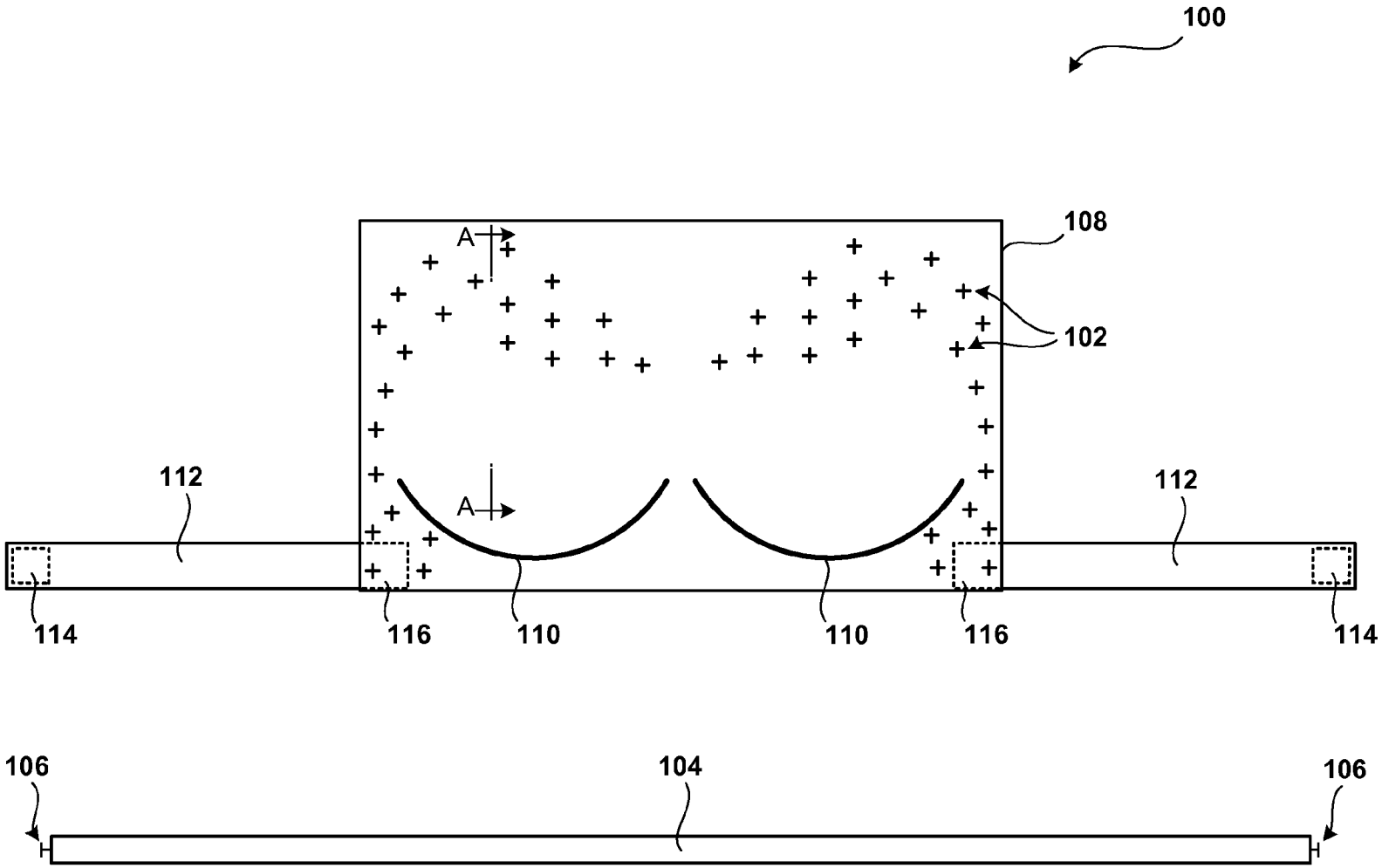
FIG. 1 illustrates a customizable brassiere, according to an exemplary embodiment.

The following detailed description is directed to customizable brassieres and methods for forming and using customizable brassieres. In the following detailed description, references are made to the accompanying drawings that form a part hereof, and in which are shown by way of illustration specific embodiments or examples. It must be understood that the disclosed embodiments are merely exemplary of the concepts and technologies disclosed herein. The concepts and technologies disclosed herein may be embodied in various and alternative forms, and/or in various combinations of the embodiments disclosed herein. The word "exemplary," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of a customizable brassiere and methods for forming and using customizable brassieres will be presented.

FIG. 1 illustrates a customizable brassiere 100 according to an exemplary embodiment. As will be explained in more detail below, the customizable brassiere 100 can be cut to a desired configuration to accommodate various necklines or other clothing or undergarment configurations, as well as personal needs and/or preferences of the wearer. A wearer can determine how to shape the customizable brassiere 100, and can cut the customizable brassiere 100 to the desired configuration using a razor, scissors, or other cutting tools, if desired. In some embodiments, the customizable brassiere 100 includes score lines and/or tear lines along popular neck line and back line configurations to allow a user to customize the customizable brassiere 100 using tearing operations instead of, or in addition to, cutting operations.

One or more access areas 102 are formed in the customizable brassiere 100. Fastening mechanisms (not visible in FIG. 1) may be located within the customizable brassiere 100 at locations corresponding to the access areas 102. The access areas 102, and the fastening mechanisms corresponding to the access areas 102, can be arranged such that one or more of the access areas 102 remain after customizing the customizable brassiere. A strap 104 can be attached to the customizable brassiere via one or more connectors 106 formed at or attached to the strap 104. The connectors 106 can engage the fastening mechanisms, and can be used to hold the customizable brassiere 100 to the wearer. These and other features of the customizable brassiere 100 will be presented herein.

The customizable brassiere 100 includes a front portion 108. The front portion 108 can include cups 110. The cups 110 may be styled according to any desired configuration including complete cups, demi-cups, and/or may be omitted, depending upon design needs and/or preferences. The cups 110 may be sized according to any desired sizing scale. For example, the cups 110 may be sized according to conventional brassiere cup sizes, e.g., sizes A-DD, and/or can be sized across a wider range of sizes to accommodate extra small and/or extra large cup sizes, e.g., AA-J.

The cups 110 may be designed in a manner substantially similar to standard soft cup brassieres and/or molded brassieres. In some embodiments, the cups 110 include underwires. The underwires can be substantially equivalent to standard underwires, floating wires, and/or removable wires, according to design needs and/or preferences. In some embodiments, the underwires may be substituted with other support mechanisms and/or padding, or may be omitted altogether.

Thus, it should be understood that the front portion 108 can be designed to function in a manner substantially similar to a shelf brassiere. Some embodiments of the front portion 108 include an elastic band for providing support under the breasts in addition to, or instead of, the cups 110. The cups 110 can be soft, semi-hardened, molded, and/or rigid. The customizable brassiere 100, and/or portions thereof including the cups 110, can be formed from any desired materials. Suitable materials include natural and synthetic fabrics such as cotton, nylon, polyester, LYCRA brand spandex, other fabrics, and combinations thereof, papers, plastics and other polymers, metals, fibers, other materials, and/or combinations thereof.

The front portion 108 may be constructed from one or more layers, each of which may be constructed of one or more materials. In addition to the materials mentioned above, one or more layers of the front portion 108 may include adhesives, dyes, and/or other applied chemicals that may be applied for various purposes including preventing fraying and/or unraveling, extending life of the customizable brassiere 100, preventing other dyes and/or chemicals from migrating or leeching from or into other layers, increasing or reducing rigidity, and/or for other purposes. Some exemplary layers and layer materials will be described below with reference to FIG. 2.

As mentioned above, the customizable brassiere 100, or one or more layers thereof, includes a number of access areas 102. The access areas 102 are illustrated in FIG. 1 as plus-shaped (+) score lines that can be severed to create an opening in one or more layers of the customizable brassiere 100. The access areas 102 can be distributed throughout the front portion 108 of the customizable brassiere 100. As mentioned above, and as will be explained below in more detail with reference to FIG. 2, fastening mechanisms can be disposed within the customizable brassiere 100, for example, sandwiched between two or more layers of the customizable brassiere 100, if desired. The fastening mechanisms can be accessed via the access areas 102, and the strap 104 can be attached to the fastening mechanism via the connectors 106 located on the strap 104. Some exemplary fastening mechanisms and connectors 106 will be described in more detail below with reference to FIG. 2.

The customizable brassiere 100 also may include attachment tabs 112. The attachment tabs 112 can be used to hold the customizable brassiere 100 in a desired position while a user marks and/or cuts the customizable brassiere 100. The attachment tabs 112 can be used to attach the customizable brassiere 100 to the user's skin, an article of clothing, a sizing chart, a template, or another structure or surface. The attachment tabs 112 can include adhesive and/or non-adhesive landing areas 114, which can be used to hold the customizable brassiere 100 in the desired position.

The landing areas 114 can include any desired materials including, but not limited to, traditional adhesives, skin-safe and/or fabric-safe adhesives, and/or mechanical attachment mechanisms such as VELCRO brand hook and loop fastener material and the like. In some embodiments, the attachment tabs 112 are formed as parts of the front portion 108. In other embodiments, the attachment tabs 112 are configured for attachment to the front portion 108 at tab landing areas 116 disposed at the front and/or the back of the front portion 108.

If desired, the attachment tabs 112 can be removed from the front portion 108. Thus, the customizable brassiere 100 can be backless, if desired, for certain applications. In some embodiments, the attachment tabs 112 are removed from the front portion 108 by pulling the attachment tabs 112 away from the tab landing areas 116, if included. In other embodiments, the attachment tabs 112 may be severed from the front portion 108 by tearing or cutting along tear lines and/or score lines formed in the front portion 108 and/or the attachment tabs 112. In one contemplated embodiment, an attachment tab 112 is removed from the front portion 108 by tearing or cutting along a tear line formed at an edge at which the front portion 108 and the attachment tabs 112 intersect. Other methods of forming the attachment tabs 112, attaching the attachment tabs 112 to the front portion 108, and/or removing the attachment tabs 112 from the front portion 108 are contemplated but will not be described herein for the sake of brevity.

The customizable brassiere 100 illustrated in FIG. 1 is illustrated as being symmetrical. It should be understood that this embodiment is merely illustrative of one contemplated embodiment of the customizable brassiere 100. In some embodiments, the customizable brassiere 100 and/or some, none, or all of the components thereof, is asymmetrical. Thus, customizable brassieres 100 with varied cup sizes, varied attachment tab lengths, varied wire lengths, varied distributions of attachment areas 102, and the like, are possible and are contemplated.

Figure 2:
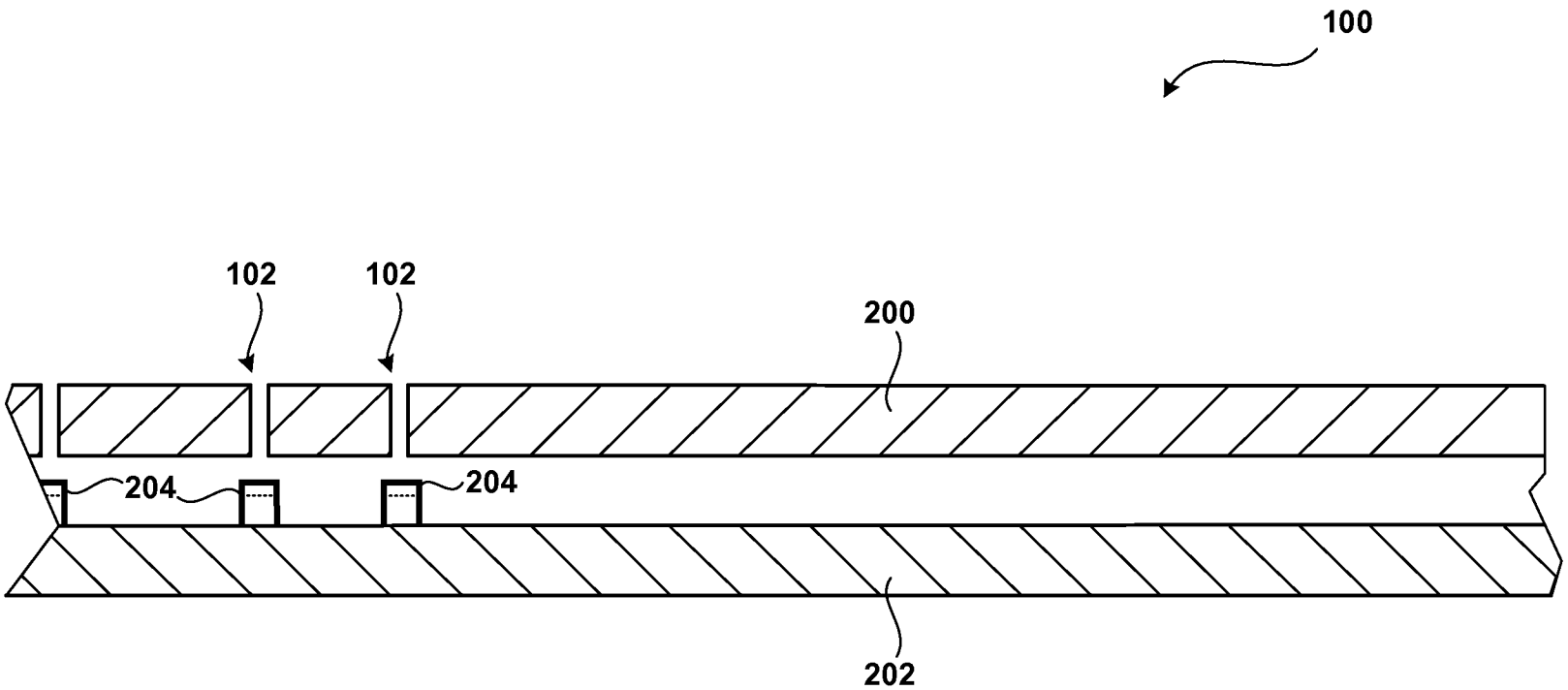
FIG. 2 illustrates a cross section of a customizable brassiere, according to an exemplary embodiment.

Referring additionally to FIG. 2, a cross section view of the customizable brassiere 100 viewed along the line A-A illustrated in FIG. 1 is illustrated, according to an exemplary embodiment. The customizable brassiere 100 includes an outer layer 200 and an inner layer 202. In the illustrated embodiment, the outer layer 200 corresponds to the layer of the customizable brassiere 100 that faces away from the wearer, and the inner layer 202 corresponds to the layer of the customizable brassiere 100 that contacts the skin of the wearer. This embodiment is merely exemplary. Furthermore, while the illustrated embodiment includes two layers, it should be understood that fewer, additional, and/or alternative layers are contemplated. Additionally, while a space is illustrated between the outer layer 200 and the inner layer 202, it should be understood that such a space may not exist in some embodiments of the customizable brassiere 100. Finally, it should be understood that conventional material indications are not used in FIG. 2 as the specific materials used for each of the layers is not necessarily important to an understanding of the concepts and technologies disclosed herein. Thus, the embodiment illustrated in FIG. 2 should be understood as being exemplary, and should not be construed as being limiting in any way.

The outer layer 200 includes the access areas 102, the size of which are exaggerated for purposes of illustration. As shown in FIG. 2, the access areas 102 have been opened to allow access to fastening mechanisms 204 located between the outer layer 200 and the inner layer 202. In the illustrated embodiment, the fastening mechanisms 204 are loops or eyes formed from metal, plastic, fabric, or other materials. The loops or eyes are configured to be engaged by the connectors 106 on the strap 104, as explained above. In the illustrated embodiment, the connectors 106 are hooks that engage an opening in the fastening mechanisms 204.

As will be more clearly understood below, some or all of the fastening mechanisms 204 can remain after the customizable brassiere 100 is customized. As such, in the illustrated embodiment, the fastening mechanisms 204 are sandwiched between the outer layer 200 and the inner layer 202 to prevent the fastening mechanisms 204 from injuring or annoying the wearer of the customizable brassiere 100, for example, by poking into or scratching the skin of the wearer. Additionally, or alternatively, the fastening mechanisms 204 may be sandwiched between the outer layer 200 and inner layer 202 for aesthetic reasons. For example, the material used to form the fastening mechanisms 204 may be visible though the clothing of the wearer, and thus may be partially or completely concealed between the outer layer 200 and the inner layer 202. Similarly, disposing the fastening mechanisms 204 between the outer layer 200 and the inner layer 202 may prevent the fastening mechanisms 204 from creating visible lumps or distortions in clothing worn on top of the customizable brassiere 100.

The fastening mechanisms 204 and the connectors 106 can be replaced by other structures, depending upon design, manufacturing, and/or marketing needs and preferences. In some contemplated embodiments, the illustrated fastening mechanisms 204 are replaced by metal, plastic, or fabric rings, button holes, snaps, VELCRO or other mechanical fasteners, and/or adhesives. These mechanisms may be engaged by hooks, buttons, snaps, VELCRO or other mechanical fasteners, adhesives, adhesive activators, and/or other structures and chemicals that are substituted for the connectors 106. Thus, it should be understood that the fastening mechanisms 204 and the connectors 106 may be replaced by almost any appropriate mechanical and/or chemical fasteners, depending upon needs and/or preferences.

In some embodiments, the outer layer 200 can be formed from natural and/or synthetic fabrics, and can look, appear, and/or feel substantially similar to a traditional brassiere or other garment. In some embodiments, the outer layer 200 is formed from paper, plastic, fibers, or other materials, depending upon design needs or preferences. Additionally, the outer layer 200 can be coated, impregnated, attached to, or treated with materials to prevent fraying or tearing of the outer layer 200. Preventing fraying or tearing of the outer layer 200 may improve the appearance and durability of the customizable brassiere 100, particularly after cutting or tearing the customizable brassiere.

In some embodiments, the inner layer 202 is formed from natural and/or synthetic fabrics, and can look, appear, and/or feel substantially similar to a traditional brassiere, brassiere lining, or another garment. The inner layer 202 also can be formed from papers, plastics, fibers, or other materials, depending upon design needs or preferences. An adhesive layer can be disposed at the inner layer 202, if desired, to allow the customizable brassiere 100 to be attached to the wearer's skin, if desired, or to create one or more landing areas such as the tab landing areas 116 described above. A release paper or other substrate can be disposed on top of the adhesive, as is generally known.

While only two layers have been described herein, it should be understood that some embodiments of the customizable brassiere 100 include additional and/or alternative layers. In some embodiments, for example, the customizable brassiere 100 includes layers to provide heat, cold, and/or moisture protection, to provide moisture wicking, to provide insulation or padding, to provide odor or bacteria protection, and the like. Thus, the illustrated and described layers should be construed as exemplary, and not as limiting in any way.

Figure 3A:
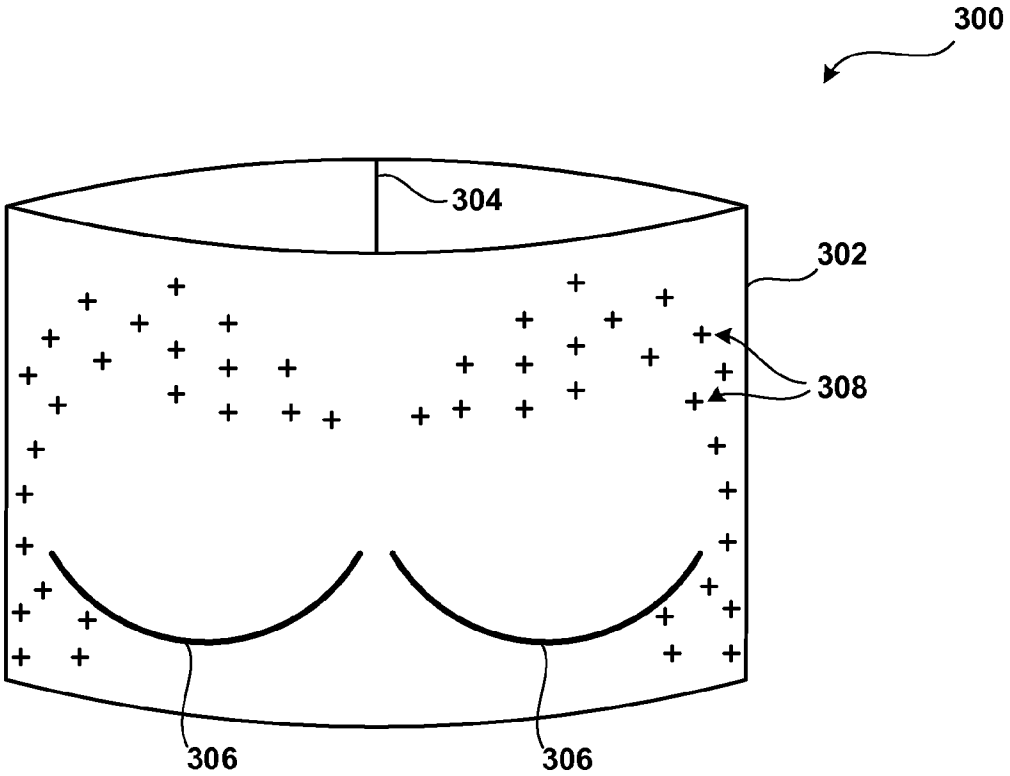
FIGS. 3A-3B illustrates a customizable brassiere, according to another exemplary embodiment.

FIG. 3A illustrates an alternative exemplary embodiment of a customizable brassiere 300. The customizable brassiere 300 includes a front portion 302 (hereinafter referred to as the "body") that is configured to wrap around the wearer during marking, cutting, and/or wearing of the customizable brassiere 300. In some embodiments, the body 302 is a substantially continuous annular ring. If desired, the body 302 can be formed of and/or can contain elastic or other elastomers to allow the body 302 to be easily put on and/or taken off. Additionally, it should be understood that the body 302 can be formed in various sizes to accommodate different sized wearers. More particularly, the body 302 can be formed in different lengths, thicknesses, widths, diameters to accommodate wearers of varied dimensions.

In some embodiments, the body 302 includes a seam 304 along which the body 302 can be opened to allow the body 302 to be easily put on and/or taken off during marking, cutting, and/or wearing. Although not illustrated in FIG. 3A, clasping mechanisms including hooks and eyes, buttons, zippers, or other mechanisms can be provided along the seam 304.

The customizable brassiere 300 includes cups 306, which can be substantially similar to the cups 110 illustrated in FIG. 1, though this is not necessarily the case. Additionally, the customizable brassiere 300 includes access areas 308, which can be substantially similar to the access areas 102 illustrated in FIG. 1.

Figure 3B:
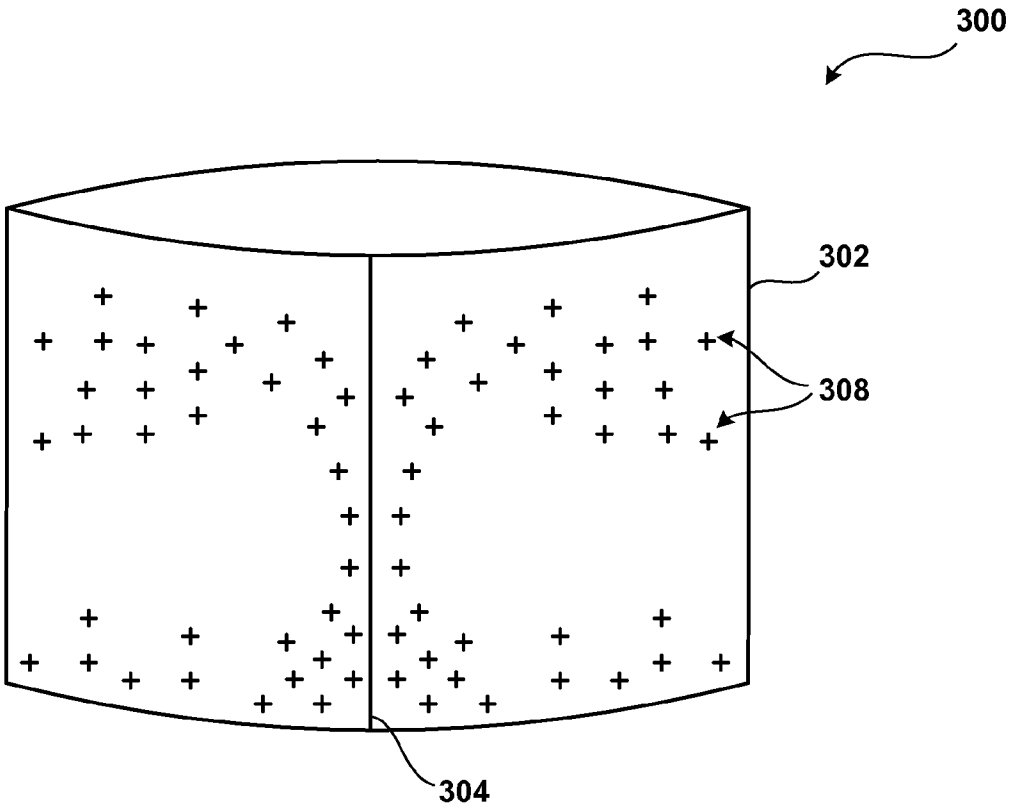

FIG. 3B illustrates a rear elevation view of the customizable brassiere 300, according to an exemplary embodiment. In the rear view, the access areas 308 are visible, as is the seam 304 described above with reference to FIG. 3A. The access areas 308 can be distributed according to various patterns at various points on the front, back, and sides of the customizable brassiere 300.

Referring now collectively to FIGS. 1-3B, customization of the customizable brassiere 100, 300 will be described in additional detail. In some embodiments, a wearer places the customizable brassiere 100, 300 into a desired position. In the case of the customizable brassiere 100, the attachment tabs 112 can be used to hold the front portion 108 in position, if desired. In the case of the customizable brassiere 300, the customizable brassiere 300 can be positioned around the upper torso of the wearer.

The customizable brassiere 100, 300 can be placed into a position at which the customizable brassiere 100, 300 is comfortable while allowing the wearer to mark and/or cut the customizable brassiere 100, 300 to a desired configuration. In one embodiment, the wearer puts on a garment or other clothing for which the customizable brassiere 100, 300 is to be customized. While wearing the customizable brassiere 100, 300 and the garment, the user can mark the customizable brassiere 100, 300 to indicate portions of the customizable brassiere 100, 300 that are visible while wearing the clothing. It should be understood that the marking may include marking the customizable brassiere 100, 300 with a pen, pencil, marker, razor, knife, or other utensil. Instead of, or in addition to marking, the wearer may mentally make note of how the customizable brassiere 100, 300 should be modified.

After marking the customizable brassiere 100, 300 as desired, the wearer can remove the garment and/or the customizable brassiere 100, 300. The user cuts or tears the customizable brassiere 100, 300. After cutting the customizable brassiere 100, 300, the configuration of the customizable brassiere 100, 300 and the configuration of the garment worn when marking the customizable brassiere 100, 300 can be substantially similar. If desired, a strap such as the strap 104 can be used with the customizable brassiere 100, 300 to accommodate various configurations of clothing and/or preferences of the wearer. Although not illustrated in the drawings, it should be understood that the strap 104 can further include an adjustable mechanism for shortening and/or lengthening the strap to accommodate various configurations and to accommodate wearers of varied dimensions. The adjustable mechanism for the strap 104 can be, but are not necessarily, similar to adjustment mechanisms used in conventional brassieres including, but not limited to, buckles and snaps. It also should be understood that the strap 104 can be used as a back strap by wrapping around the back of the wearer and/or as a shoulder strap by wrapping around the shoulders of the wearer.

Thus, it can now be understood how to configure the placement of the access areas 102, 308. According to various embodiments, the access areas 102, 308, as well as the fastening mechanism 204, can be strategically placed to increase the probability that at least one fastening mechanism 204 remains in the customizable brassiere 100, 300 after cutting the customizable brassiere 100, 300 to a desired configuration.

In some embodiments, the customizable brassiere 100, 300 is designed and sold according to particular neck lines and/or back configurations. Thus, the access areas 102, 308 can be aligned in a base pattern that is substantially similar to or approximates the particular neck line and/or back configuration. The base pattern can be produced at a position that is proximate to the cups 110, 306, and can be reproduced a number of times, wherein each reproduction of the pattern is offset from the previous reproduction a distance that approximates increases and decreases in wearer height, weight, dress size, and other anticipated or known factors.

Contemplated configurations for the access areas 102, 308 include various patterns associated with necklines including, but are not limited to, v-necklines, high v-necklines, deep v-necklines, plunging v-necklines, jewel necklines, boat or ballet necklines, sweetheart necklines, and square necklines, among others. Additionally, or alternatively, the configurations of the access areas 102, 308 can be determined based upon various strap and back configurations including, but not limited to, strapless applications, backless applications, spaghetti strap applications, halter-top applications, single strap applications, bandeau top applications, and/or other applications. It should be understood that the above configurations are not exhaustive, and are merely illustrative of possible configurations.

In other embodiments, the placement of the access areas 102, 308 is configured to accommodate a large number of possible neckline, strap, and back configurations. Thus, a single embodiment of the customizable brassiere 100, 300 can be configured to accommodate a wide range of neckline, strap, and back configurations. For example, a pattern according to which the access areas 102, 308 are located, can include a combination of multiple patterns corresponding to multiple anticipated uses. The access areas 102, 308, and/or cut or tear lines, can be marked on the customizable brassiere 100, 300. In some embodiments, multiple cut or tear lines and/or access area 102, 308 patterns are marked on the customizable brassiere 100, 300 with lines, dots, or other indications. Different patterns corresponding to different uses, neck lines, or the like, can be marked with different colors, and a legend can be included in the package or printed on the customizable brassiere 100, 300, if desired.

In some embodiments, the customizable brassiere 100, 300 includes a back closure or a side closure to accommodate a "razor-back" configuration. The back or side closure can include clasps, hooks, zippers, and/or other fastening mechanisms, if desired. In some embodiments, the customizable brassiere 100, 300 includes a back closure and two side closures. Thus, if one or both of the side closures are cut away or rendered inoperable during customization, the back closure may remain. Similarly, if the back closure is rendered inoperable during customization, one or more of the side closures may remain. In yet another embodiment, the customizable brassiere 100, 300 includes a front clasp or other fastening mechanism, which may be included with one or all of the back closures, a side closure, and/or two side closures.

Based on the foregoing, it should be appreciated that customizable brassieres and methods for forming and using customizable brassieres have been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A brassiere blank comprising a material used to form a brassiere, the brassiere blank comprising:

a brassiere outer layer comprising a material with a plurality of access areas therein, the plurality of access areas including a first access area and a second access area, at least one of the plurality of access areas comprising a score line that is selectively severed by the wearer to create an opening in the brassiere outer layer;

a brassiere inner layer comprising a material configured for placement adjacent to skin of the wearer;

a strap comprising at least one of a shoulder strap or a back strap for the brassiere, the shoulder strap being of a first length to span from the first access area to the second access area about shoulders of a wearer of the brassiere, and the back strap being of a second length to span about the back of the wearer as a back band for the brassiere, the strap comprising connectors comprising a first connector at a first end of the strap and a second connector at a second end of the strap; and a plurality of fastening mechanisms located between the brassiere outer layer and the brassiere inner layer, the plurality of fastening mechanisms being located at locations corresponding to the plurality of access areas of the brassiere outer layer and being configured to engage at least one of the connectors of the strap, wherein the at least one of the connectors engages at least one of the plurality of fastening mechanisms via the at least one of the plurality of access areas, wherein the brassiere blank is configured to be cut to a desired final brassiere shape by the wearer.

2. The brassiere blank of claim 1, wherein the locations of the access areas are configured such that at least one of the plurality of access areas remains after the brassiere is cut to the desired final brassiere shape.

3. The brassiere blank of claim 1, further comprising a cup formed in the brassiere.

4. The brassiere blank of claim 3, further comprising an underwire located in the cup.

5. The brassiere blank of claim 1, wherein the at least one of the plurality of fastening mechanisms comprises a loop, and wherein the connector comprises a hook.

6. The brassiere blank of claim 1, wherein the at least one of the plurality of fastening mechanisms comprises a button hole, and the connector comprises a button.

7. The brassiere blank of claim 1, further comprising an adhesive layer attached to the brassiere inner layer, wherein the adhesive layer is configured to adhere to skin of the wearer to hold the brassiere in a desired position relative to the skin of the wearer.

8. The brassiere blank of claim 1, further comprising an adhesive layer attached to the brassiere outer layer, wherein the adhesive is configured to contact a garment worn on top of the brassiere to secure the brassiere in a desired position relative to the garment.

9. The brassiere blank of claim 1, further comprising an attachment tab configured to hold the brassiere in a desired position relative to at least one of a garment of the wearer or skin of the wearer.

10. The brassiere blank of claim 9, wherein the attachment tab is removable from the brassiere.

11. A brassiere blank comprising a material used to form a brassiere, the brassiere blank comprising:

a strap comprising at least one of a shoulder strap or a back strap for the brassiere, the shoulder strap being of a first length to span from a first access area to a second access area about shoulders of a wearer of the brassiere, and the back strap being of a second length to span about the back of the wearer as a back band for the brassiere, the strap comprising connectors including a first connector at a first end of the strap and a second connector at a second end of the strap;

a brassiere outer layer comprising a material with a plurality of access areas therein, the plurality of access areas including the first access area and the second access area, wherein the brassiere is configured to be cut to a desired final brassiere shape by a wearer of the brassiere, and wherein the access areas are located such that at least one of the plurality of access areas remains after the brassiere is cut to the desired final brassiere shape by the wearer, at least one of the plurality of access areas comprising a score line that is selectively severed by the wearer to create an opening in the brassiere outer layer;

a brassiere inner layer comprising a material configured for placement adjacent to skin of the wearer; and a plurality of fastening mechanisms located between the brassiere outer layer and the brassiere inner layer, the plurality of fastening mechanisms being located at locations corresponding to the plurality of access areas of the brassiere outer layer and being configured to engage at least one of the connectors of the strap, wherein the at least one of the connectors is configured to engage at least one of the plurality fastening mechanisms via the at least one of the plurality of access areas.

12. The brassiere blank of claim 11, further comprising two attachment tabs configured to hold the brassiere in a desired position, wherein the attachment tabs are removable from the brassiere.

13. A brassiere blank comprising a material used to form a brassiere, the brassiere blank comprising:

a front portion comprising two cups and being formed from a brassiere outer layer comprising a material with a plurality of access areas comprising a first access area and a second access area, wherein the brassiere is configured to be cut to a desired final brassiere shape by a wearer of the brassiere, and wherein the plurality of access areas are located such that at least one of the plurality of access areas remains after the brassiere is cut to the desired final brassiere shape, and wherein at least one of the plurality of access areas comprises a score line that is selectively severed by the wearer to create an opening in the brassiere outer layer, a brassiere inner layer comprising a material configured for placement adjacent to skin of the wearer, and a plurality of fastening mechanisms located between the brassiere outer layer the brassiere inner layer, the plurality of fastening mechanisms being located at locations corresponding to the plurality of access areas of the brassiere outer layer;

two attachment tabs configured to hold the front portion in a desired position relative to the wearer to allow the wearer to customize the brassiere, wherein the attachment tabs are removable from the brassiere; and a strap comprising at least one of a shoulder strap or a back strap for the brassiere, the shoulder strap comprising a first end and a second end and being of a first length to span from the first access area to the second access area about shoulders of a wearer of the brassiere, and the back strap being of a second length to span about the back of the wearer as a back band for the brassiere, the strap comprising connectors including a first connector at the first end of the strap and a second connector at the second end of the strap, the connectors being configured to engage at least one of the plurality of fastening mechanisms to form the back strap or the shoulder strap for the brassiere.

14. The brassiere blank of claim 1, further comprising an attachment tab configured to hold the brassiere in a desired position relative skin of the wearer, wherein the attachment tab comprises an adhesive that is configured to contact the skin of the wearer to secure the brassiere in a desired position relative to the skin to allow the wearer to cut the brassiere to a desired final brassiere shape, and wherein the attachment tab is removable from the brassiere.

15. The brassiere blank of claim 1, further comprising an attachment tab configured to hold the brassiere in a desired position relative to a garment worn on top of the brassiere, wherein the attachment tab comprises an adhesive that is configured to contact the garment to secure the brassiere in a desired position relative to the garment to allow the wearer to cut the brassiere to the desired final brassiere shape, and wherein the attachment tab is removable from the brassiere by tearing along a further score line formed in the brassiere.

16. The brassiere blank of claim 11, wherein at least one of the brassiere outer layer or the brassiere inner layer is formed from paper.

17. The brassiere blank of claim 11, wherein at least one of the brassiere outer layer or the brassiere inner layer is formed from a fabric, and wherein the fabric is coated or impregnated with a material to prevent fraying of the fabric if the brassiere is cut.

18. The brassiere blank of claim 13, wherein at least one of the brassiere outer layer or the brassiere inner layer is formed from paper, wherein the connectors comprise hooks, and wherein the plurality of fastening mechanisms comprise loops.

19. The brassiere blank of claim 13, wherein at least one of the connectors or the fastening mechanisms comprises a snap.

* * * * *